US009382807B2

(12) United States Patent
Grover et al.

(10) Patent No.: US 9,382,807 B2
(45) Date of Patent: Jul. 5, 2016

(54) NON-AXISYMMETRIC RIM CAVITY FEATURES TO IMPROVE SEALING EFFICIENCIES

(75) Inventors: Eric A. Grover, Tolland, CT (US); Thomas J. Praisner, Colchester, CT (US); Joel H. Wagner, Wethersfield, CT (US)

(73) Assignee: United Technologies Corporation, Farmington, CT (US)

( * ) Notice: Subject to any disclaimer, the term of this patent is extended or adjusted under 35 U.S.C. 154(b) by 855 days.

(21) Appl. No.: 13/466,254

(22) Filed: May 8, 2012

(65) Prior Publication Data

US 2013/0302136 A1 Nov. 14, 2013

(51) Int. Cl.

| | |
|---|---|
| ***F01D 11/02*** | (2006.01) |
| ***F01D 11/00*** | (2006.01) |
| ***F01D 5/08*** | (2006.01) |

(52) U.S. Cl.

CPC ..... *F01D 11/001* (2013.01); *F01D 5/081* (2013.01); *F01D 11/02* (2013.01); *F05D 2250/73* (2013.01); *F05D 2260/97* (2013.01)

(58) Field of Classification Search

CPC ... F01D 11/001; F01D 11/003; F01D 11/006; F01D 11/02; F05D 2240/55; F05D 2240/127; F05D 2250/20; F05D 2250/28; F05D 2250/294

USPC ..... 415/173.7, 174.5

See application file for complete search history.

(56) References Cited

U.S. PATENT DOCUMENTS

| | | | | |
|---|---|---|---|---|
| 4,218,189 | A | 8/1980 | Pask | |
| 4,348,157 | A | 9/1982 | Campbell et al. | |
| 4,776,779 | A * | 10/1988 | Crump | F01C 1/165 417/197 |
| 7,320,574 | B2 * | 1/2008 | Greim et al. | 415/173.5 |
| 7,465,152 | B2 * | 12/2008 | Nigmatulin | 415/170.1 |
| 7,540,709 | B1 | 6/2009 | Ebert | |
| 7,967,559 | B2 * | 6/2011 | Bunker | 415/173.7 |
| 8,016,552 | B2 * | 9/2011 | Bunker | 415/173.7 |
| 8,038,399 | B1 | 10/2011 | Liang | |
| 2005/0265825 | A1 | 12/2005 | Lewis | |
| 2006/0269398 | A1 | 11/2006 | Marini et al. | |
| 2006/0269400 | A1 | 11/2006 | Girgis et al. | |
| 2008/0080972 | A1 * | 4/2008 | Bunker | 415/174.5 |
| 2008/0298969 | A1 * | 12/2008 | Bunker | 416/182 |

FOREIGN PATENT DOCUMENTS

| | | | |
|---|---|---|---|
| EP | 2369138 | A1 | 9/2011 |
| FR | 2602847 | A1 * | 2/1988 |

* cited by examiner

*Primary Examiner* — Ninh H Nguyen
*Assistant Examiner* — Jesse Prager
(74) *Attorney, Agent, or Firm* — Bachman & LaPointe, P.C.

(57) ABSTRACT

Turbomachinery, such as a gas turbine engine, has parts with opposed first and second surfaces and with a cavity between the surfaces and with the first surface moving relative to the second surface. The turbomachinery further has at least one feature for creating pressure variations incorporated into the first and second surfaces.

5 Claims, 6 Drawing Sheets

NON-AXISYMMETRIC RIM CAVITY FEATURES TO IMPROVE SEALING EFFICIENCIES

BACKGROUND

The present disclosure relates to turbomachinery, such as gas turbine engines, having two surfaces which move relative to each other and which have features on the surfaces which create variations in pressure within a cavity between the two surfaces.

The rim cavity regions of turbomachinery applications, specifically within the turbine and compressor portions of a gas turbine engine, can pose significant challenges to the performance of the turbomachinery. For example, within turbines, the rim cavity regions should be kept cool with respect to the high main-flow temperatures in order to preclude thermal damage and to help extend component life. Cold purge air may be introduced into cavities to keep out main gas path air. However, the introduction of such purge air may reduce turbine efficiency. Within a compressor, the rim cavity may be pressurized to prevent high-pressure air from leaking forward. Improvements to the rim cavity in terms of reduced purge flow and/or cavity wall temperature are desirable since they make a direct improvement to the turbomachinery.

SUMMARY

In accordance with the present disclosure, there is provided turbomachinery which broadly comprises a first part having a first surface and a second part having a second surface; a cavity between the first and second surfaces; the first surface moving relative to the second surface; and means for creating variations in pressure incorporated into the first and second surfaces.

In another and alternative embodiment, the first surface comprises a stationary surface and the second surface comprises a rotating surface.

In another and alternative embodiment, the first surface and the second surface both rotate at differing speeds.

In another and alternative embodiment, each of the first and second surfaces are an axial surface, wherein each axial surface parallels a centerline of the turbomachinery.

In another and alternative embodiment, each of the first and second surfaces are a radial surface, wherein each radial surface is substantially perpendicular to a centerline of the turbomachinery.

In another and alternative embodiment, each of the first and second surfaces are slanted or curved.

In another and alternative embodiment, the means for creating the pressure variations comprises at least one non-axisymmetric two dimensional feature on each of the surfaces.

In another and alternative embodiment, the means for creating the pressure variations comprises a plurality of non-axisymmetric two dimension features on each of the surfaces.

In another and alternative embodiment, the means for creating the pressure variations comprises at least one non-axisymmetric three dimensional feature incorporated into each of the surfaces.

In another and alternative embodiment, the at least one non-axisymmetric three dimensional feature incorporated into the first surface is offset from the at least one non-axisymmetric three dimensional feature incorporated into the second surface.

In another and alternative embodiment, the at least one non-axisymmetric three dimensional feature comprises at least one non-axisymmetric three dimensional feature which extends outwardly from the respective surface.

In another and alternative embodiment, the at least one non-axisymmetric three dimensional feature comprises at least one non-axisymmetric three dimensional feature which extends inwardly from the respective surface.

In another and alternative embodiment, the at least one non-axisymmetric three dimensional feature incorporated into the first surface comprises at least one three dimensional feature which extends outwardly from the first surface and the at least one non-axisymmetric three dimensional feature incorporated into the second surface comprises at least one three dimensional feature which extends inwardly from the second surface.

In another and alternative embodiment, the means for creating pressure variations comprises a first non-axisymmetric feature having a first shape incorporated into the first surface and a second non-axisymmetric feature having a second shape different from the first shape incorporated into the second surface.

In another and alternative embodiment, the turbomachinery comprises a gas turbine engine.

In another and alternative embodiment, the first surface comprises a surface of a vane and the second surface comprises a surface of a blade.

Additionally, the present disclosure is directed to a process for creating pressure variations within a cavity which broadly comprises the steps of: providing a first part having a first surface and a second part having a second surface defining a cavity between said first and second surfaces; incorporating means for creating pressure variations into said first and second surfaces; and moving said first surface relative to said second surface.

In another and alternative embodiment, the moving step comprises maintaining said second surface stationary and rotating said first surface relative to said second surface.

In another and alternative embodiment, the moving step comprises rotating both said first surface and said second surface at different speeds.

In another and alternative embodiment, the providing step comprises providing a first axial surface and a second axial surface opposed to said first axial surface.

In another and alternative embodiment, the providing step comprises providing a first radial surface and a second radial surface opposed to said first radial surface.

In another and alternative embodiment, the providing step comprises providing a first slanted or curved surface and a second slanted or curved surface.

In another and alternative embodiment, the incorporating step comprises incorporating at least one non-axisymmetric two dimensional feature on each of said surfaces.

In another and alternative embodiment, the incorporating step comprises incorporating a plurality of non-axisymmetric two dimensional features on each of said surfaces.

In another and alternative embodiment, the incorporating step comprises incorporating at least one non-axisymmetric three dimensional feature on each of said surfaces.

In another and alternative embodiment, the incorporating step comprises incorporating said at least one non-axisymmetric three dimensional feature on said first surface offset from said at least one non-axisymmetric three dimensional feature incorporated on said second surface.

In another and alternative embodiment, the incorporating step comprises incorporating at least one non-axisymmetric three dimensional feature which extends outwardly from said respective surface.

In another and alternative embodiment, the incorporating step comprises incorporating at least one non-axisymmetric three dimensional feature which extends inwardly from said respective surface.

In another and alternative embodiment, the incorporating step comprises incorporating at least one non-axisymmetric three dimensional feature into said first surface which extends outwardly from said first surface and incorporating said at least one non-axisymmetric three dimensional feature into said second surface so that said at least one non-axisymmetric three dimensional feature extends inwardly from said second surface.

In another and alternative embodiment, the incorporating step comprises incorporating a first non-axisymmetric feature having a first shape into said first surface and incorporating a second non-axisymmetric feature having a second shape different from said first shape into said second surface.

In another and alternative embodiment, the first surface providing step comprises providing a surface of a vane and wherein said second surface providing step comprises providing a surface of a blade.

Other details of the non-axisymmetric rim cavity features are set forth in the following detailed description and the accompanying drawings wherein like reference numerals depict like elements.

DETAILED DESCRIPTION

As used herein, the term "two dimensional feature" refers to a feature that generally vary only in a circumferential direction.

As used herein, the term "three dimensional feature" refers to a feature that generally vary in the circumferential and radial directions.

Figure 1:
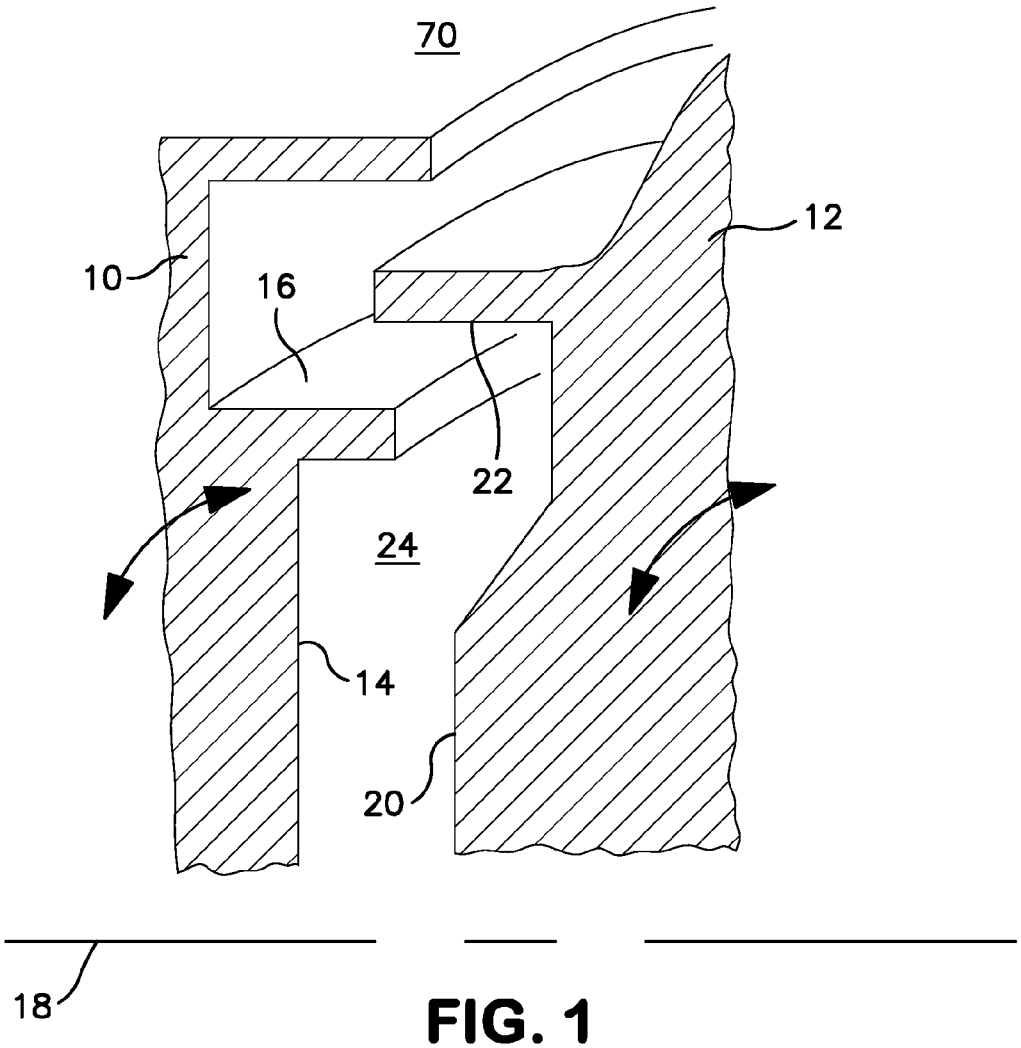
FIG. 1 is a schematic representation of a portion of turbomachinery.

Referring now to the drawings, FIG. 1 illustrates a segment of turbomachinery in which there exists a first part 10 and a second part 12 which moves relative to the first part 10. One of the parts 10 and 12 may be stationary and the other of the parts 10 and 12 may be rotatable. Alternatively, both parts 10 and 12 may be rotatable. If desired, the parts 10 and 12 may rotate at different speeds relative to each other.

As can be seen from FIG. 1, the part 10 may have a radially extending surface 14 which is in whole or in part substantially perpendicular to a centerline axis 18 of the turbomachinery and/or an axially extending surface (axial surface) 16 which is substantially parallel to the centerline axis 18 of the turbomachinery. Similarly, the part 12 may have a radially extending surface (radial surface) 20 which is in whole or in part substantially perpendicular to the centerline axis and/or an axially extending surface 22 which is substantially parallel to the centerline axis 18. If desired, the surfaces 14, 16, 20 and 22 may be flat surfaces, linear surfaces, slanted surfaces and/or curved surfaces. Between the surfaces 14 and 20 and the surfaces 16 and 22 is a channel or cavity 24.

It has been found to be desirable to create variations in pressure within the cavity 24 to improve sealing efficiency. To this end, the surfaces 14, 16, 20 and 22 may have non-axisymmetric features incorporated therein. The non-axisymmetric features may comprises features which extend outwardly from the respective surface 14, 16, 20, and 22 or features which extend inwardly from the respective surface 14, 16, 20, and 22. Each surface 14, 16, 20, and 22 may have one such feature or a plurality of such features. On a radially extending surface, the plurality of features may be disposed in a radial direction and/or in a circumferential direction. On an axially extending surface, the plurality of features may be disposed in an axial direction and/or in a circumferential direction.

The non-axisymmetric features may be two dimensional features incorporated into one of the surfaces 14, 16, 20, and 22. Alternatively, the non-axisymmetric features may be three dimensional features incorporated into one of the surfaces 14, 16, 20, and 22. Still further, the non-axisymmetric features may have a smooth surface or an irregular surface.

In order to create variations in pressure, a first non-axisymmetric feature may be incorporated on a first surface and a second non-axisymmetric feature may be incorporated into a second surface opposed to the first surface. The first non-axisymmetric feature may be offset from the second non-axisymmetric feature. The offset may be a radial offset. Alternatively, it may be a circumferential or axial offset.

Figure 2:
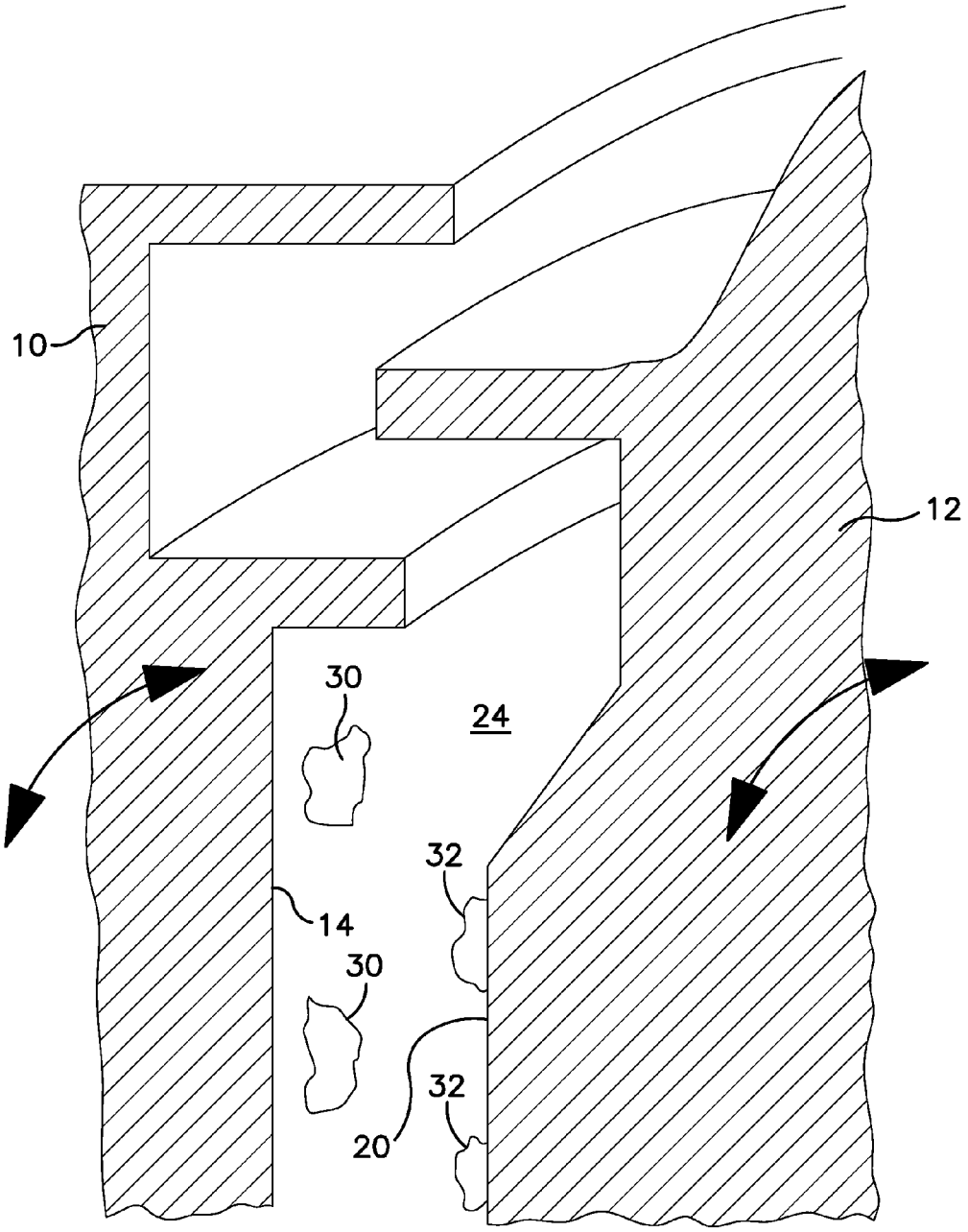
FIG. 2 is a schematic representation of an embodiment of a system for creating pressure variations within a cavity.

Referring now to FIGS. 2-5, there are shown turbomachinery parts having means for creating pressure variations. FIG. 2 illustrates a first part 10 having a plurality of non-axisymmetric features or shapes 30 on a first radially extending surface 14 and a second part 12 having a plurality of non-axisymmetric features or shapes 32 on a second, opposed radially extending surface 20. As the part 12 rotates relative to the part 10, movement of the features 30 and 32 create pressure variations within the cavity 24. As can be seen from FIG. 2, the features 30 and 32 may be offset with respect to each other.

Figure 3:
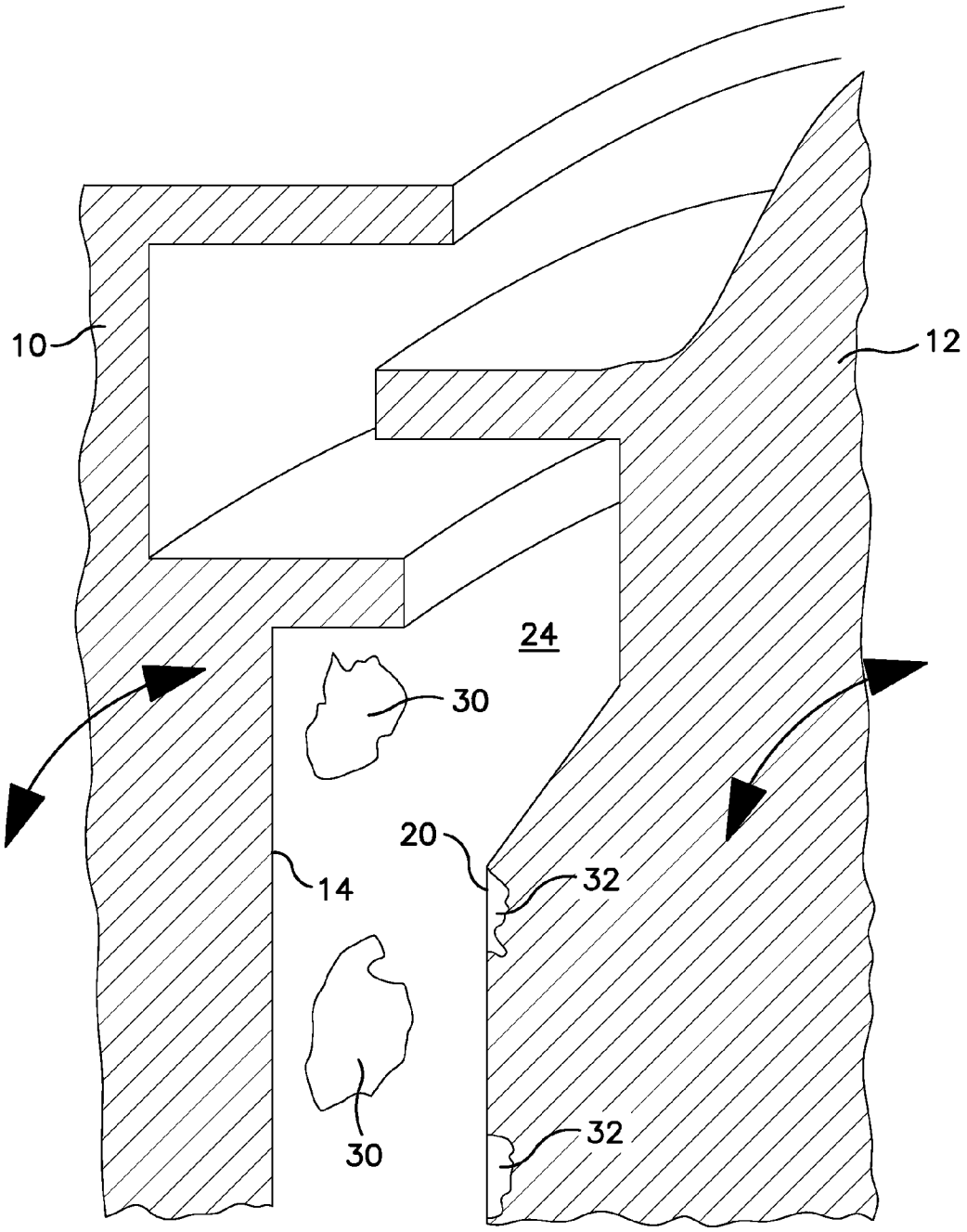
FIG. 3 is a schematic representation of a first alternative embodiment of a system for creating pressure variations within a cavity.

Referring now to FIG. 3, there is shown a first part 10 having a plurality of non-axisymmetric features 30 extending inwardly of the radially extending surface 14. There is also shown a second part 12 having a plurality of non-axisymmetric features 32 extending inwardly on a second, opposed radially extending surface 20. Again, as the part 12 rotates relative to the part 10, movement of the features 30 and 32 create pressure variations within the cavity 24. As can be seen from FIG. 3, the features 30 and 32 may be offset with respect to each other.

Figure 4:
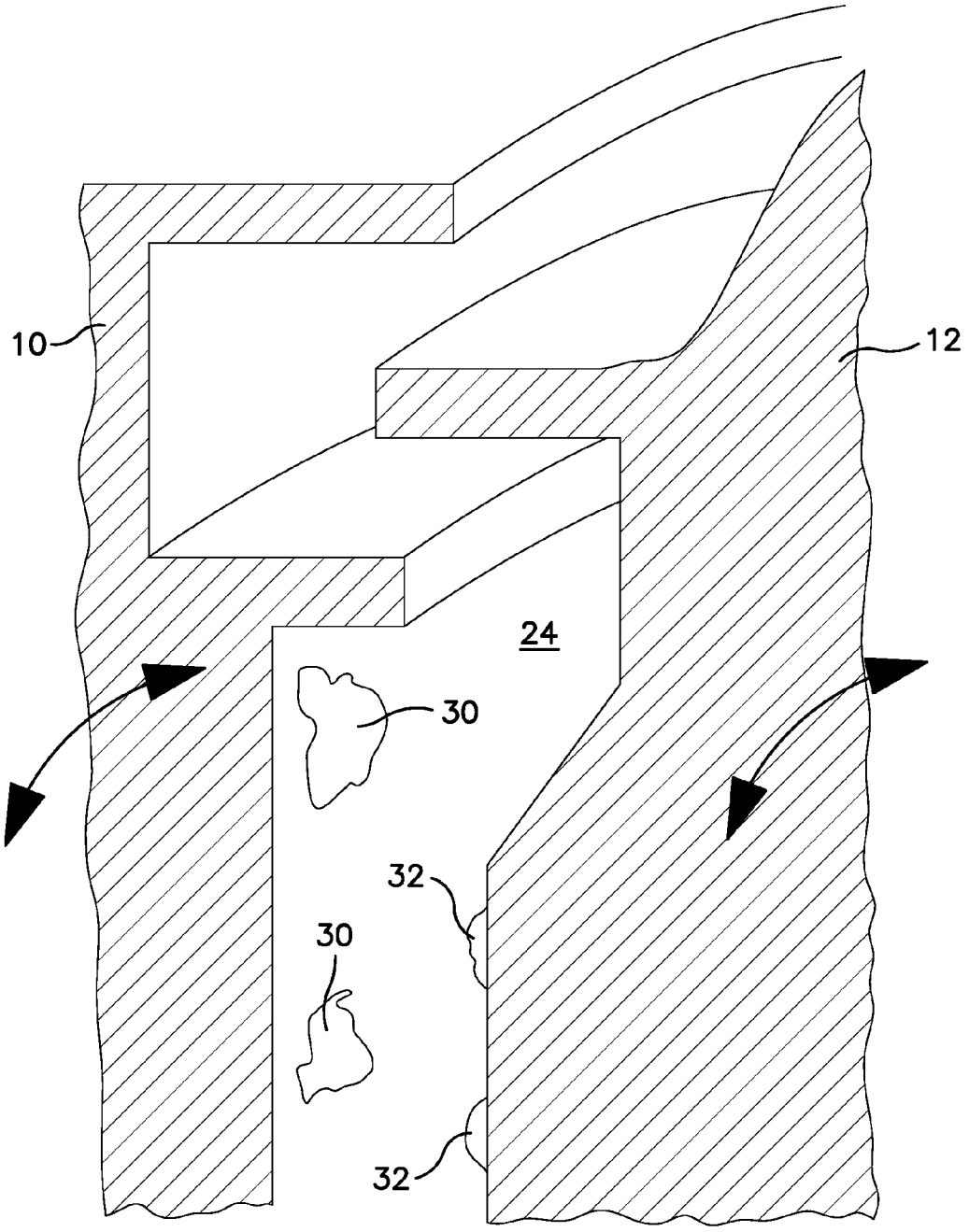
FIG. 4 is a schematic representation of a second alternative embodiment of a system for creating pressure variations within a cavity.

Referring now to FIG. 4, there is shown a first part 10 having a plurality of non-axisymmetric features 30 extending inwardly of the radially extending surface 14. There is also shown a second part 12 having a plurality of non-axisymmetric features 32 which extend outwardly from a second, opposed radially extending surface 20. Again, as the part 12 rotates relative to the part 10, movement of the features 30 and 32 create pressure variations within the cavity 24. As can be seen from FIG. 4, the features 30 and 32 may be offset with respect to each other.

Figure 5:
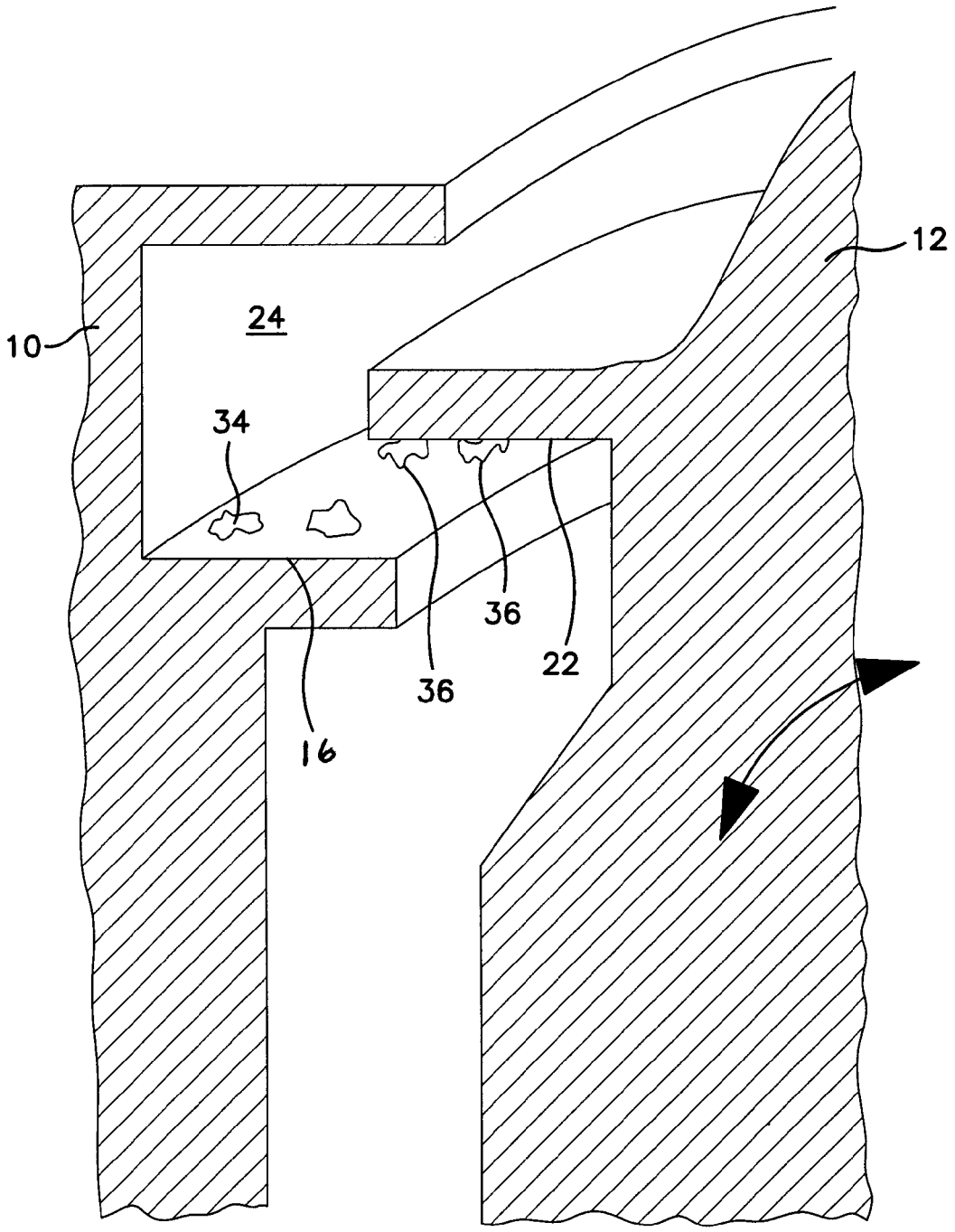
FIG. 5 is a schematic representation of a third alternative embodiment of a system for creating pressure variations within a cavity.

Referring now to FIG. 5, there is shown a first part 10 having a plurality of non-axisymmetric features 34 on an axially extending surface 16. There is also shown a second part 12 having a plurality of non-axisymmetric features 36 on a second, opposed axially extending surface 22. The features 34 and 36 may extend outwardly from the respective surfaces 16 and 22 or may extend inwardly from the respective surfaces 16 and 22. As the part 12 rotates relative to the part 10, movement of the features 34 and 36 create pressure variations within the cavity 24. As can be seen from FIG. 5, the features 34 and 36 may be offset with respect to each other.

Figure 6:
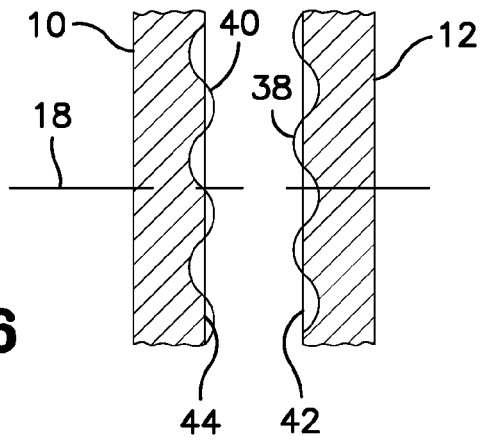
FIG. 6 is a schematic representation of a fourth alternative embodiment of a system for creating pressure variations within a cavity.

Referring now to FIG. 6, there is shown an embodiment where the pressure variation creating features are formed by two dimensional features 38 and 40 incorporated into two opposed surfaces 42 and 44. The two opposed surfaces 42 and 44 could be radially extending surfaces or axially extending surfaces.

Figure 7:
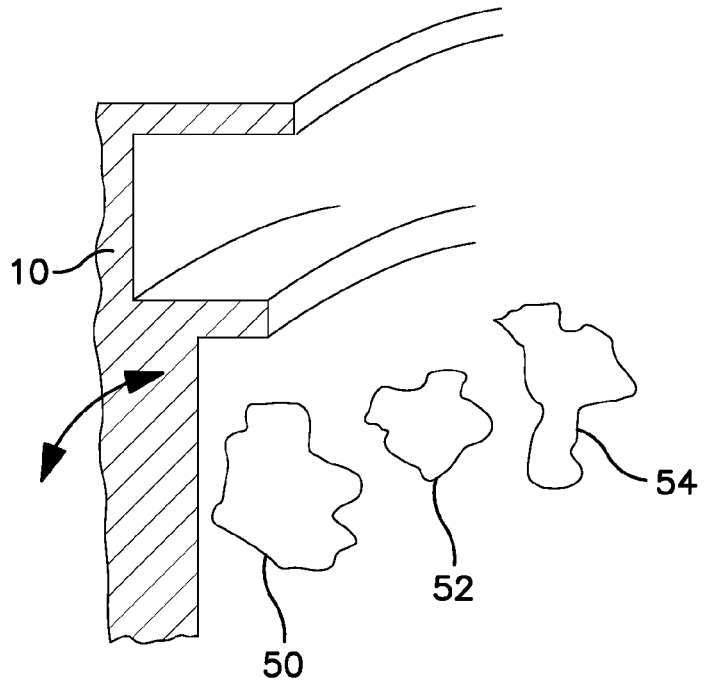
FIG. 7 is a schematic representation of non-axisymmetric shapes which can be used to create pressure variations within a cavity.
Figure 8:
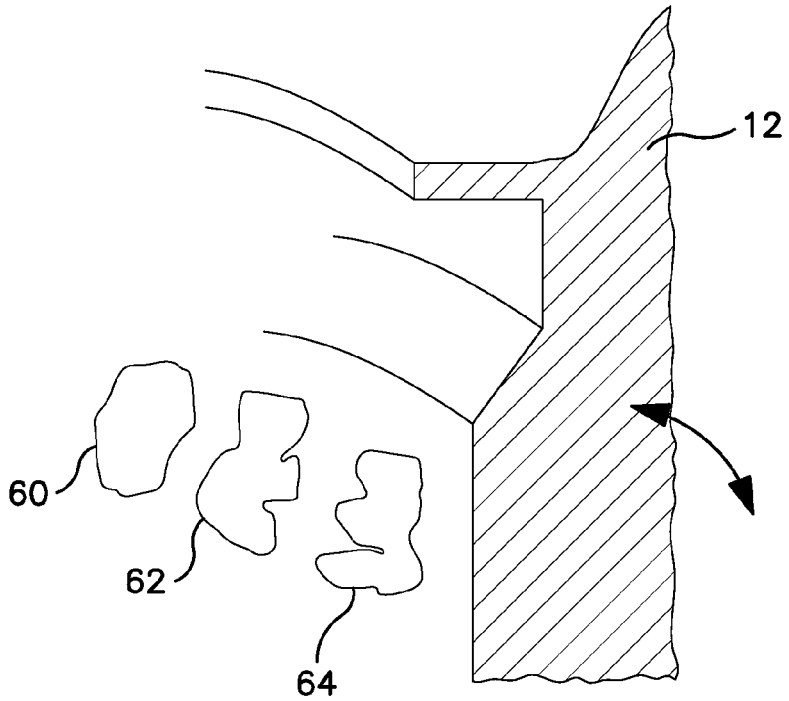
FIG. 8 is a schematic representation of non-axisymmetric shapes which can be used to create pressure variations within a cavity.

FIG. 7 illustrates non-axisymmetric features 50, 52, and 54 which could be incorporated into one of the parts 10 and 12. FIG. 8 illustrates other non-axisymmetric features 60, 62, and 64 which could be incorporated into one of the parts 10 and 12. The shapes may be arbitrary.

The turbomachinery on which the parts 10 and 12 are located could be a gas turbine engine in which the part 10 is a turbine or compressor vane and part 12 is a turbine or compressor blade. The cavity 24 may contain rim cavity purge air which makes its way toward a main gas path 70. The cavity 24 may be a channel defined by the adjacent surfaces of consecutive airfoil platforms. Since the airfoils of the vane and the blade will be rotating with respect to each other, the adjacent walls of the cavity 24 will be rotating with respect to each other. This relative motion allows for the discrete non-axisymmetric features to be added to the surfaces. As these features pass each other, they induce pressure variations in the flow due to temporal variations in the gap flow area. These pressure variations should interact with the flow field pressure variations induced by airfoil motion within the main gas path in such a way as to suppress flow ingestion into the cavity 24.

One of the benefits of the pressure variation creation means discussed herein is component efficiency. In the case of turbines, there is a reduced hot gas ingestion which provides for a better life margin for the engine. The generation of the pressure variations counteracts main gas path ingestion.

There has been provided in accordance with the instant disclosure non-axisymmetric rim cavity features to improve sealing efficiencies. While the non-axisymmetric rim cavity features have been shown in the context of specific embodiments thereof, other unforeseen alternatives, modifications, and variations may become apparent to those skilled in the art having read the foregoing description. Accordingly, it is intended to embrace those alternative, modifications, and variations which fall within the broad scope of the appended claims.

What is claimed is:

1. Turbomachinery comprising:

a first part having a first surface and a second part having a second surface, each of said first and second surfaces are an axial surface, and each said axial surface parallels a centerline of said turbomachinery, wherein said first surface and said second surface both rotate;

a cavity between said first and second surfaces;

said first surface moving relative to said second surface; and at least one non-axisymmetric three dimensional feature which extends outwardly into said cavity in both the circumferential and radial directions from said first and second surfaces.

2. Turbomachinery according to claim 1, wherein said first surface and said second surface both rotate at differing speeds.

3. Turbomachinery according to claim 1, wherein said at least one non-axisymmetric three dimensional feature incorporated into said first surface is offset from said at least one non-axisymmetric three dimensional feature incorporated into said second surface.

4. Turbomachinery according to claim 1, wherein at least one non-axisymmetric three dimensional feature comprises a first non-axisymmetric feature having a first shape incorporated into said first surface and a second non-axisymmetric feature having a second shape different from said first shape incorporated into said second surface.

5. Turbomachinery according to claim 1, wherein said turbomachinery comprises a gas turbine engine.

* * * * *